US006643960B2

(12) United States Patent
Manfiotto

(10) Patent No.: US 6,643,960 B2
(45) Date of Patent: Nov. 11, 2003

(54) COLLAPSIBLE SUPPORT FRAME PARTICULARLY FOR IRONING BOARDS

(75) Inventor: Arcangelo Manfiotto, Romano d'Ezzelino (IT)

(73) Assignee: Axana 2000 srl, Romano d'Ezzelino (IT)

( * ) Notice: Subject to any disclaimer, the term of this patent is extended or adjusted under 35 U.S.C. 154(b) by 0 days.

(21) Appl. No.: 10/147,902

(22) Filed: May 20, 2002

(65) Prior Publication Data

US 2003/0000117 A1 Jan. 2, 2003

(30) Foreign Application Priority Data

May 21, 2001 (EP) ..... 01830324

(51) Int. Cl.[7] ..... D06F 81/02
(52) U.S. Cl. ..... 38/137; 38/DIG. 3
(58) Field of Search ..... 38/103, 137, DIG. 1, 38/DIG. 2, DIG. 3; 248/188.1, 188.2, 188.3, 188.6, 188.91; 108/176, 173, 166, 162, 117, 131

(56) References Cited

U.S. PATENT DOCUMENTS 4,431,153 A * 2/1984 Kritske ..... 248/188.1
5,335,432 A * 8/1994 Simpson ..... 38/106
6,014,827 A * 1/2000 Lehrman ..... 38/104
6,443,075 B1 * 9/2002 Hahn et al. ..... 108/147
6,523,797 B2 * 2/2003 LeClair et al. ..... 248/286.1

FOREIGN PATENT DOCUMENTS

| | | |
|---|---|---|
| DE | 2461773 | 2/1981 |
| EP | 1029969 A2 | 8/2000 |
| IT | VR960033 | 1/1998 |

* cited by examiner

*Primary Examiner*—Ismael Izaguirre
(74) *Attorney, Agent, or Firm*—Young & Thompson

(57) ABSTRACT

A collapsible support frame for an ironing board includes a ground bearing base, an arm having one end linked to the bearing base and the other end that can be restrained to the ironing board, and a blocking removable apparatus acting on the arm and on the bearing base, and the ironing board to maintain the arm erected in a working position at an adjustable level above the bearing base. The blocking apparatus includes two strut elements, one has its end articulated to the arm, and the other of which to the bearing base. The other strut element is articulated to the arm and to the ironing board, and to locking removable device that locks the position of the strut elements. Each strut has a plurality of plate-shaped elements, with friction spacing elements between adjacent elements. Each strut has one end articulated to the arm and the other end provided with a slot for loose articulation. The locking removable device has a tension rod acting to engage the slots and to pack the plate-shaped elements elastic elements to load the tension rod and an operation device. The plate-shaped elements include a group of sliding plate-shaped elements and a group of friction plate-shaped elements.

10 Claims, 2 Drawing Sheets

COLLAPSIBLE SUPPORT FRAME PARTICULARLY FOR IRONING BOARDS

BACKGROUND OF THE INVENTION

The present invention relates to an improvement in a collapsible frame support frame, particularly for ironing boards.

More specifically, the invention concerns an ironing board having a Z-shaped support, providing technical solutions sufficient to guarantee an optimum operation and absolutely under safety conditions.

As it is well known, they have been suggested in the past, with a very wide diffusion in the market, X-shaped collapsible ironing boards, that, even quite satisfying under many points of view, are quite heavy, bulky and complicated to be used.

Recently, some solutions providing a Z-shaped frame have been suggested.

A particularly advantageous solution is that suggested in the utility model patent Application No VR96U000015, filed on Jul. 9, 1996 in the name of Axana S.r.I., and concerning collapsible support frame, particularly for ironing boards.

Main object of the above-mentioned patent Application was that of providing a collapsible support frame very light and comprised of a reduced number of components, and that was easily collapsible and erectable.

Another object was that the collapsible support frame was manufactured with competitive prices and thus was advantageous even under the economical point of view.

These and other objects were reached suggesting a collapsible support frame, particularly for ironing boards, comprising a ground bearing base, an arm having one end linked with the bearing base and the other end that can be restrained to the ironing board, so as to be erectable in a working position, in correspondence of which it supports the ironing board at an operative level above and far from the bearing base, and a rest position, in correspondence of which it is collapsed against the bearing base, and blocking removable means acting both on the arm and on the bearing base and on the ironing board to maintain said arm in the working position at an adjustable level above the bearing base.

Furthermore, in said utility model Application, stop means are described comprising automatic means for erecting and collapsing said frame between the rest position and the working position.

The solution according to the previous utility model patent Application, even if valid under a technical point of view, has some problems that do not allow a valid and safe technical use.

Particularly, some problems have been noted in the support system allowing to maintain erected a Z-shaped structure as described in the previous utility model patent Application.

Furthermore, some studies have been made allowing its use under maximum safety conditions.

Another problem noted is that concerning the possibility of easily moving and putting back the ironing board.

SUMMARY OF THE INVENTION

In view of the above, the Applicant has developed a technical solution allowing to solve the above-mentioned problems, thus allowing to have an absolutely "in the van" ironing board.

It is therefore specific object of the present invention a collapsible support frame, particularly for ironing boards, comprising a ground bearing base, at least an arm having one end linked with the bearing base and the other end that can be restrained to the ironing board, and blocking removable means acting both on the arm, or on the arms, and on the bearing base, and on the ironing board to maintain said arm erected in a working position at an adjustable level above the bearing base, wherein said blocking removable means comprise at least two strut elements, one of which has its end articulated, when used, respectively one to said arm, or arms, and the other one to said bearing base, while the other strut element is articulated, when used, to said arm, or arms, and to the ironing board, and locking removable means to lock the position of said strut elements, each strut element comprising a plurality of plate-shaped element, packed by the interposition of a friction spacing element between two adjacent plate-shaped elements, and each one providing one end articulated to the arm or arms or to the bearing base, or to the ironing board, the other end provided with a slot for the loose articulation, to the bearing base or to the ironing board, or to the arm, or arms, respectively, and said locking removable means providing a tension rod, axially slidably mounted, and acting to engage the slots and to pack said plurality of plate-shaped elements, elastic means to load the tension rod, and an operation device, suitable to neutralise, upon activation, the elastic loading force of the tension rod, thus allowing the sliding displacement each other between plate-shaped elements and tension rod, said collapsible frame being characterised in that the plurality of plate-shaped elements of each element is comprised of a group of sliding plate-shaped elements and of a group of friction plate-shaped elements, each group of sliding plate-shaped elements providing at least 7 elements and each one of group of friction plate-shaped elements providing at least 8 elements, each group of plate-shaped elements of each strut element providing elastic means for packing the plate-shaped sliding elements and the plate-shaped friction elements.

Preferably, according to the invention, said plate-shaped friction elements are realised by block moulds, thus obtaining a perfect planarity.

Particularly, said plate-shaped elements are comprised of iron C70, with a single trimming.

Still according to the invention, said plate-shaped sliding elements are comprised of iron, subjected to tumbler system galvanisation, thus eliminating the punching burrs.

Always according to the invention, said packing elastic means can be comprised of an adiprene 95 spring shore D.25, or 95 shore D20, with the consequent increase of the number of blades and of the plates.

Furthermore, according to the invention, said frame provides a safety pedal as blocking means acting to maintain the arm erected on the bearing base, shaped in such a way to be necessary a semi-rotation of the same pedal before allowing the unlocking of the block.

It is further provided a plastic material, triangular shaped element, shaped in such a way to avoid the falling of the ironing board in case of unintentional pressure on the pedal.

Still according to the invention, said collapsible frame provides at least two wheels provided under said bearing base, and sliding on the ground when the collapsible frame is in a closed position, thus allowing its motion according to a transverse direction, and at least two wheels on said arm, in correspondence of its end articulated to said bearing base, sliding on the ground when said collapsible frame is closed, thus allowing its motion according to a longitudinal direction.

Preferably, according to the invention, said operation device comprises a cam sliding engaging on one end of said tension rod and suitable to push the tension rod against the action of said elastic loading means, and a control lever for said cam.

Furthermore, according to the invention, said lever provides a curve in correspondence of the pushing point of said elastic means.

BRIEF DESCRIPTION OF THE DRAWINGS

The present invention will be now described, for illustrative but not limitative purposes, according to its preferred embodiments, with particular reference to the figures of the enclosed drawings, wherein.

DESCRIPTION OF THE PREFERRED EMBODIMENTS

Figure 1:
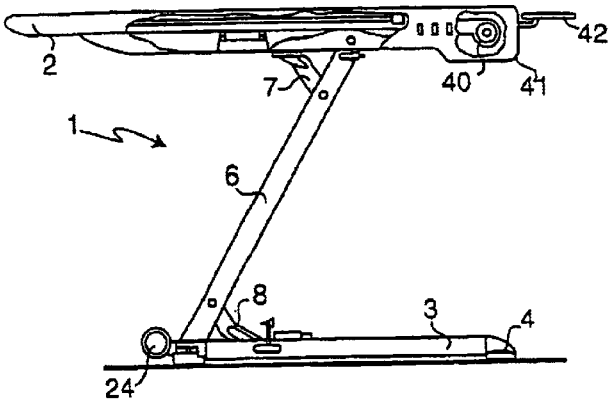
FIG. 1 is a lateral elevation view of a collapsible frame for an ironing board, in the working erected position.
Figure 2:
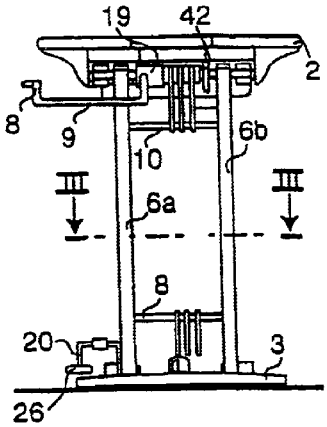
FIG. 2 shows a lateral right view of FIG. 1.
Figure 3:
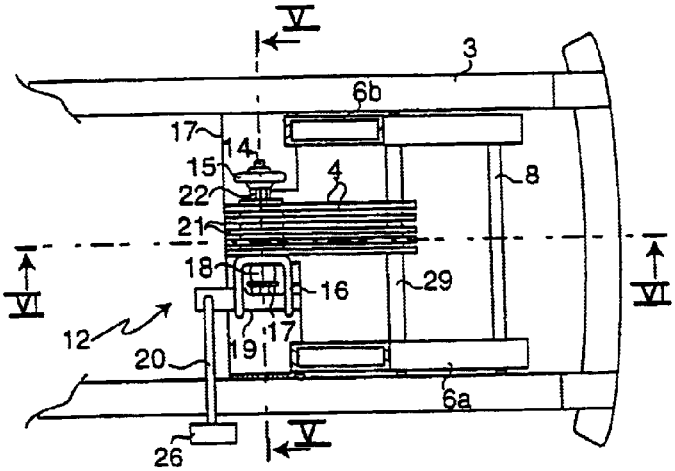
FIG. 3 is a partial section view according to line III—III of FIG. 1.

In FIGS. 1–6 a frame according to the invention is shown, the main features of which are those of a specific embodiment of the previous utility model patent Application No VR96U000015.

In the example shown in FIGS. 1–6, it is shown an erectable and collapsible frame, which is generically indicated by the reference number 1, for an ironing board 2, comprised of a frame 3, for example comprised of light alloy or of a suitable synthetic material, that can have a rectangular configuration and provided in correspondence of its angles with a ground bearing foot 4, advantageously of the height adjustable kind, for example by screwing. Frame 3 is oriented in such a way to have its long sides substantially parallel to the long lateral sides of the ironing board 2.

One arm 6 provides one end coupled with the ironing board 2 and one end coupled with the frame 3.

In the solution shown, struts 6*a* and 6*b* are kept in an erected position by two packs of plates or blades: an upper one 7 between a blocking device, that is generically indicated by reference number 9, under the ironing board 2, and an upper transverse one 10 between struts 6*a* and 6*b*, and a lower group of plates or blades between transverse lower element 11 and struts 6*a* and 6*b* and a locking device 12 supported by the bearing base 3.

In the following it will be described in greater detail the lower blocking device 12 into the bearing base 3, being provided that the blocking device 8 above the struts 6*a* and 6*b* is realised in function of, and in an analogous way with respect to the blocking device 11.

Each blade or plate 7, 8 provides one end articulated to a respective transverse element 10, 11 of the struts 6*a*, 6*b*, while its other end is coupled to a slot (FIG. 6), that is loose sliding coupled on a pin or tension rod 14 provided parallel to the transverse elements 10, 11, respectively. Pin 14 is slidably mounted on two spaced support brackets, or on a ear 15 an a U-shaped bracket 16, welded, or coupled in another way, to a support plate 17, supported by the bearing base 3.

The tension rod or pin 14 extends between the two flaps of the U-shaped bracket 16, said tension rod or pin 14 having an hexagonal head 17 acting as abutment for an elastic loading element 18, e.g. a rubber ring that, on one side abuts against the hexagonal head 17 and on the other side against the flat bottom of the U-shaped 16.

In correspondence of its free end, the hexagonal head 17 slidably abuts against a cam 19, rotating mounted on the flaps of the U-shaped bracket 16. One end of the cam 19 is fixed to a hand actuated or pedal actuated lever 20 to control the cam 19. The plates 7, 8 pack is mounted on the pin 14 by safety washers 21 kept pushed against the bracket 16 by pack pushes against the bracket 16 by a nut 22 screwed on the pin 2 within the bracket 15.

By this arrangement, the plate pack 8 is normally maintained blocked by the blocking force of the elastic locking means 18, while once the pedal 20 is actuated, pedal 20 will cause the squeezing of the elastic means 18, and thus the release of the plates 7 or 8 so that they can slide along the pin 14.

Figure 4:
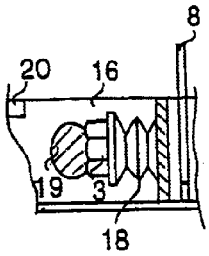
FIG. 4 shows a particular, with some parts sectioned, of FIG. 3.
Figure 5:
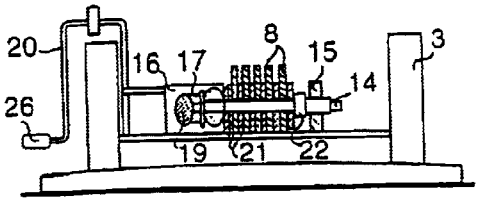
FIG. 5 is a section view taken along line V—V of FIG. 3.
Figure 6:
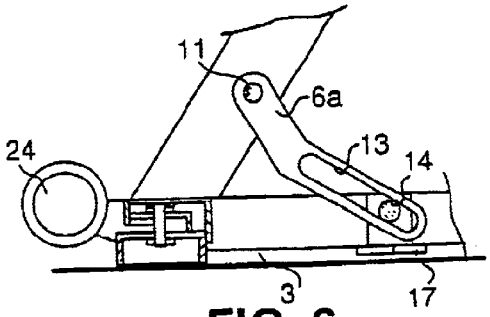
FIG. 6 is a section view taken along line VI—VI of FIG. 3.

Advantageously, the elastic element 18 can also be comprised of opposed springs, as shown in FIG. 4.

To erect the collapsible frame according to this example of realisation it must before squeeze the lower pedal 20 and then the struts 6*a* and 6*b* are lifted, with the ironing board bearing on them. Once reached the wished level to operate on the ironing board 2, pedal 20 is released, so that plates 8 will be blocked. Then, lever 20 is pushed on the side of the ironing board 2 and the board 2 is placed in a horizontal position, afterward the lever 20 is released, so that the ironing board 2 is erected to work.

To collapse the frame it is obviously necessary to operate according to a contrary sequence.

Figure 7:
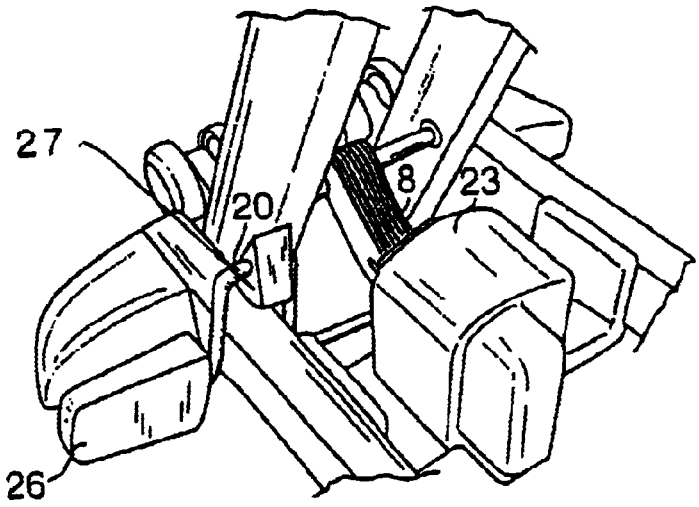
FIG. 7 shows a first particular of the ironing board shown in the preceding figures.

Observing now FIG. 7, it is particularly shown the plate pack 8 realised according to the invention, providing eight sliding plates 8 and nine friction plates 8. It is further provided a spring 23 keeping packed the sliding plates 8 with the friction plates 8.

Sliding plates 8 could be seven and the friction plate 8 could be eight. Higher is the number of plates and higher are the blocking features.

On the lever 20, a pedal 24 is provided, said pedal 24 being shaped in such a way to require a semi-rotation to release the plates 8 group.

Acting on the spring 23, the same is compressed, thus releasing the compression of the plates 8 and allowing the sliding for the closure (or opening) the table 1.

Figure 8:
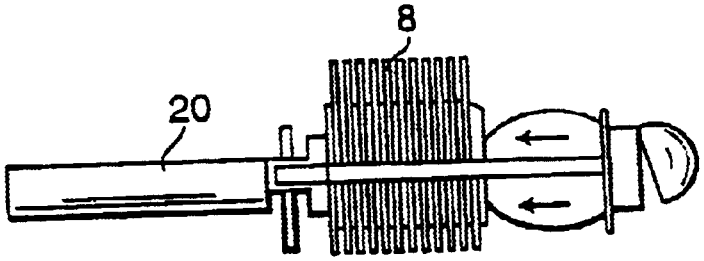
FIG. 8 is a lateral view of a second particular of the ironing board of the previous figures.
Figure 9:
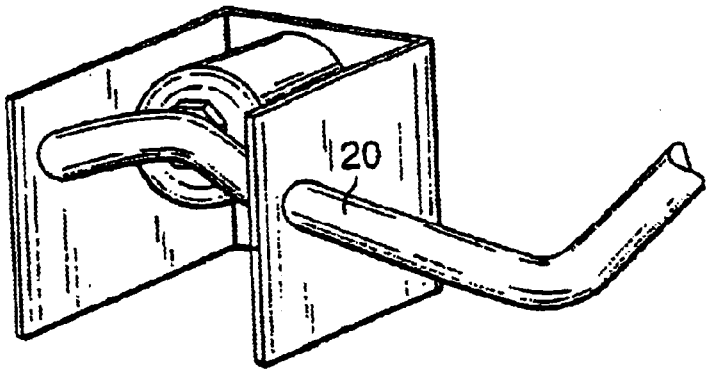
FIG. 9 is a top view of the particular of the previous claim.

Observing now also FIGS. 8 and 9, it can be observed the lever 20 providing, in the pushing point of the spring, a curved part 25.

Further, as already said, board 1 according to the invention provides at least two wheels 24 under said bearing base 3 and sliding on the floor when the collapsible frame 1 is closed, thus allowing its motion according to a transverse direction, and at least two wheels 25 on said arm 6, in correspondence of its arm articulated on said bearing base 3, and sliding on the floor when said collapsible frame 1 is closed, thus allowing its motion along a longitudinal direction.

In the previous solution, sliding plates and friction plates are comprised of an iron flat sheet, cut by laser, with sliding plates having a thickness 12/10 and friction plates having a thickness 20/10. Friction plates was tumbled and thus subjected to a hardening surface treatment (nitriding). Spring 23 was comprised of adriprene D.20, with a hardness of 92 Shore.

In the present situation, said friction plates are realised by block moulds, thus obtaining a perfect planarity. Particularly, said friction plates are comprised of iron C70, with a single trimming.

Further, said sliding plates are comprised of iron, which is afterwards galvanised by a tumbler system, thus eliminating the punching burrs.

Packing spring 23 is comprised by an adiprene 95 shore D.25 spring.

Finally, lever 20 was comprised of a rod iron having a diameter of 12 mm, and the point where the spring pushes is milled, while in the solution according to the present invention a rod iron having a diameter of 8 mm and curved in the pushing point is used.

The wheels 24 allow the forward motion of the board 2 according to the invention, and the wheels 25 allow the lateral motion of the board 2 according to the invention.

To obtain the forward motion it is necessary to slightly forward incline the board 2, in order to bring the wheels 24 in touch with the floor.

In the same way, to obtain the lateral motion of the board 2, it is necessary to slightly incline the board 2 in such a way to bring the wheels 25 in touch with the floor.

As it can be noted from the enclosed figures, frame according to the invention is further provided with a safety pedal 26, that is the blocking means acting to maintain the erected arm on the bearing base 3, shaped in such a way to require a semi-rotation of the same pedal 26 before allowing the release of the block.

It is further provided a triangular element 27, preferably comprised of plastic material, shaped in such a way to avoid the fall of the board in case of unintentional pressure on the pedal.

The present invention has been described for illustrative but not limitative purposes, according to its preferred embodiments, but it is to be understood that modifications and/or changes can be introduced by those skilled in the art without departing from the relevant scope as defined in the enclosed claims.

What is claimed is:

1. A collapsible support frame for an ironing board, comprising:

a ground bearing base;

at least an arm having one end linked with the bearing base and an other end restrained to the ironing board; and blocking removable means acting both on the arm and on the bearing base, and on the ironing board to maintain said arm erected in a working position at an adjustable level above the bearing base, wherein said blocking removable means comprises, at least two strut elements, one of which has ends articulated, when used, respectively to said arm and to said bearing base, while the other of the two strut elements is articulated, when used, to said arm and to the ironing board, and locking removable means for locking the position of said strut elements, each of said strut elements comprising a plurality of plate-shaped elements, packed with a friction spacing element between two adjacent ones of the plate-shaped elements, and having one end articulated to the arm or to the bearing base, or to the ironing board, and another end provided with a slot for loose articulation to the bearing base or to the ironing board, or to the arm, respectively, said locking removable means comprising a tension rod, axially slidably mounted, and acting to engage the slot and to pack said plurality of plate-shaped elements, and elastic means to load the tension rod, and an operation device, for neutralizing, upon activation, the elastic loading force of the tension rod, thus allowing the sliding displacement each other between plate-shaped elements and tension rod, wherein the plurality of plate-shaped elements is comprised of a group of sliding plate-shaped elements and of a group of friction plate-shaped elements, each said group of sliding plate-shaped elements providing at least 7 elements and each said group of friction plate-shaped elements providing at least 8 elements, each group of plate-shaped elements of each strut element providing elastic means for packing the plate-shaped sliding elements and the plate-shaped friction elements.

2. The collapsible support frame according to claim 1, wherein said plate-shaped friction elements comprise block molds for providing perfect planarity.

3. The collapsible support frame according to claim 1, wherein said plate-shaped elements are comprised of iron C70, with a single trimming.

4. The collapsible support frame according to claim 1, wherein said plate-shaped sliding elements are comprised of iron, subjected to tumbler system galvanisation, thus eliminating the punching burrs.

5. The collapsible support frame according to claim 1, wherein said packing elastic means is comprised of an adiprene 95 spring shore D.25.

6. The collapsible support frame according to claim 1, wherein said frame comprises a safety pedal that maintains the arm erected on the bearing base and that is shaped in such a way to require a semi-rotation of the pedal before unlocking.

7. The collapsible support frame according to claim 6, wherein a plastic material, triangular shaped element, shaped in such a way to avoid the falling of the ironing board in case of unintentional pressure on the pedal, is provided on said pedal.

8. The collapsible support frame according to claim 1, wherein said collapsible frame comprises at least two wheels under said bearing base, and sliding on the ground when the collapsible frame is in a closed position, thus allowing its motion according to a transverse direction, and at least two wheels on said arm, in correspondence of its end articulated to said bearing base, sliding on the ground when said collapsible frame is closed, thus allowing its motion according to a longitudinal direction.

9. The collapsible support frame according to claim 1, wherein said operation device comprises a cam sliding engaging on one end of said tension rod and suitable to push the tension rod against the action of said elastic loading means, and a control lever for said cam.

10. The collapsible support frame according to claim 1, wherein said lever comprises a curve in correspondence of a pushing point of said elastic means.

* * * * *